US006957464B1

(12) United States Patent
Coauette

(10) Patent No.: US 6,957,464 B1
(45) Date of Patent: Oct. 25, 2005

(54) CRIB BUMPER

(75) Inventor: Vivan Faye Coauette, Fort Mill, SC (US)

(73) Assignee: Springs Industries, Inc., Fort Mill, SC (US)

( * ) Notice: Subject to any disclaimer, the term of this patent is extended or adjusted under 35 U.S.C. 154(b) by 0 days.

(21) Appl. No.: 10/928,054

(22) Filed: Aug. 27, 2004

(51) Int. Cl.[7] ..... A47D 15/00
(52) U.S. Cl. ..... 5/663; 5/946; 5/426
(58) Field of Search ..... 5/424, 425, 426, 5/663, 93.1, 98.1, 946

(56) References Cited

U.S. PATENT DOCUMENTS

| | | | | |
|---|---|---|---|---|
| 3,619,824 A | | 11/1971 | Doyle | |
| 3,877,090 A | * | 4/1975 | Schutz | 5/93.1 |
| 4,022,502 A | | 5/1977 | Smith et al. | |
| 4,370,765 A | | 2/1983 | Webber | |
| 4,483,028 A | | 11/1984 | Payne | |
| 4,521,930 A | | 6/1985 | Henson | |
| 4,538,309 A | | 9/1985 | Gunter | |
| 5,233,710 A | | 8/1993 | Bernard | |
| 5,410,765 A | * | 5/1995 | Youngblood | 5/93.1 |
| 5,450,640 A | | 9/1995 | Patton et al. | |
| 5,577,277 A | | 11/1996 | Sundberg et al. | |
| 5,706,534 A | * | 1/1998 | Sherman | 5/424 |
| 5,761,756 A | | 6/1998 | Nowak et al. | |
| 5,806,112 A | * | 9/1998 | Harms | 5/93.1 |
| 6,170,101 B1 | * | 1/2001 | McCloud | 5/424 |

* cited by examiner

*Primary Examiner*—Michael Trettel
(74) *Attorney, Agent, or Firm*—Alston & Bird LLP

(57) ABSTRACT

A crib bumper comprises flexible, resiliently cushioning bumper panel material defining a plurality of downwardly opening pockets spaced apart along a length of the bumper panel material, and a generally L-shaped insert for at least some of the pockets, each insert defining a horizontal leg structured and arranged to be slipped beneath a crib mattress and a vertical leg that projects upwardly alongside the mattress. The vertical legs of the inserts are structured and arranged to be received into the pockets in the bumper panel material, such that the inserts position the bumper panel material in a vertical orientation adjacent the crib mattress.

20 Claims, 2 Drawing Sheets

CRIB BUMPER

BACKGROUND OF THE INVENTION

The invention generally relates to cribs for babies and infants, and more particularly relates to a crib bumper.

A crib bumper is a device used with cribs for providing resilient cushioning material adjacent the crib walls to prevent a baby or infant from hitting his or her head on the hard crib walls. Crib bumpers also help prevent arms or legs from poking out between the spaced slats and getting stuck. A typical crib bumper comprises four flexible, resiliently cushioning panels of generally rectangular configuration, connected end-to-end. The panels usually have a core of resilient foam or other cushioning material such as fiber, and a fabric or plastic covering. Traditional designs for a crib bumper utilize ties for securing the panels to the slats or corner posts of the crib. This arrangement works well for crib designs that employ spaced-apart wooden slats along all sides.

A number of crib designs have solid end walls, while other cribs have one side wall that is solid. Depending on the placement of the solid side and/or end walls, securing one or more of the panels of a conventional crib bumper to the crib can present a challenge.

BRIEF SUMMARY OF THE INVENTION

The invention addresses the above needs and achieves other advantages. A crib bumper in accordance with one embodiment of the invention comprises flexible, resiliently cushioning bumper panel material defining a plurality of downwardly opening pockets spaced apart along a length of the bumper panel material, and a generally L-shaped insert for each pocket, each insert defining a horizontal leg structured and arranged to be slipped beneath a crib mattress and a vertical leg that projects upwardly alongside the mattress. The vertical legs of the inserts are structured and arranged to be received into the pockets in the bumper panel material, such that the inserts position the bumper panel material in a vertical orientation adjacent the crib mattress.

The bumper panel material can comprise a string of four interconnected bumper panels, each bumper panel structured and arranged to extend along a respective one of four sides of a crib mattress. One or more of the panels can define one or more downwardly opening pockets.

In one embodiment of the invention, each of the inserts is convertible from a first position to a second position, the first and second positions having different heights of the vertical leg relative to the horizontal leg. Accordingly, by converting the inserts from one position to the other, the height of the bumper panels relative to the mattress can be varied. The inserts can be made convertible in various ways. In simplest form, one leg of the insert is longer than the other; the shorter leg is employed as the vertical leg when the bumper panels are to be in a relatively lower position, and the longer leg is employed as the vertical leg when the panels are to be in a relatively higher position. In this simple form, the two legs can be rigidly connected to each other if desired. To convert the inserts from one position to the other, they must be removed from the pockets and from beneath the mattress, and then must be reinserted in the other position.

In a preferred embodiment, however, the inserts are convertible without having to remove them from the pockets or from beneath the mattress. In this embodiment, each insert includes an intermediate portion between the vertical leg and the horizontal leg, a first hinge connecting the vertical leg to one edge of the intermediate portion, and a second hinge connecting an opposite edge of the intermediate portion to the horizontal leg. Each of the hinges is structured and arranged to allow the intermediate portion to be pivoted between coplanar and perpendicular positions relative to the respective legs. Thus, the first position of each insert has the intermediate portion coplanar with the horizontal leg and perpendicular to the vertical leg, and the second position of each insert has the intermediate portion coplanar with the vertical leg and perpendicular to the horizontal leg. Stated differently, the process of converting the insert from one position to the other entails shifting the break point between the horizontal portion and the vertical portion from one hinge to the other. This can be accomplished while the inserts are installed.

The inserts can be formed of molded plastic and the hinges can comprise living hinges. Alternatively, the inserts can comprise panels of stiff cardboard or the like covered with a plastic or vinyl covering, similar in construction to a 3-ring binder. The inserts advantageously have length and width dimensions that are substantially greater than the thickness dimension.

The crib bumper can also include ties for securing the bumper to structural members of a crib.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
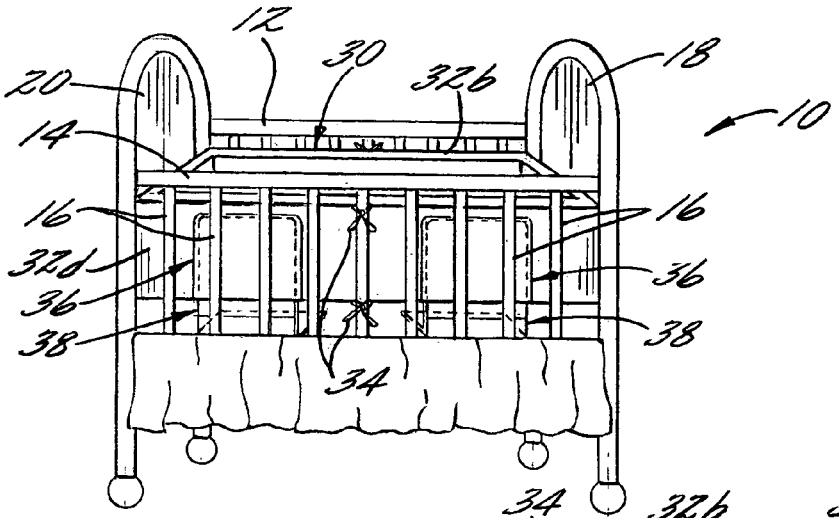
FIG. 1 is a perspective view of a first type of crib with a bumper in accordance with one embodiment of the invention.

The particular embodiment of the invention described below and shown in the drawings may be referred to as a "universal" crib bumper, in that it is configured to be usable with a variety of different crib types commonly sold. Briefly, some cribs have spaced vertical slats or bars along all four sides of the crib. Other cribs, however, employ one or more solid sides, which do not provide any locations for securing a conventional crib bumper via the ties that are typically employed for this purpose. FIG. 1 shows a crib 10, for example, that has two opposite side walls 12 and 14 each having spaced vertical slats 16, and two opposite end walls 18 and 20 that are solid. The presence of the solid end walls can present a challenge in attaching a crib bumper with ties. Although some cribs provide a small gap between the solid panel of the end wall and the adjacent corner posts so that ties can be passed around the corner posts, it would be advantageous for manufacturing simplicity if the gaps could be omitted, but then conventional crib bumpers would be difficult or impossible to secure to the crib at the end walls.

Figure 7:
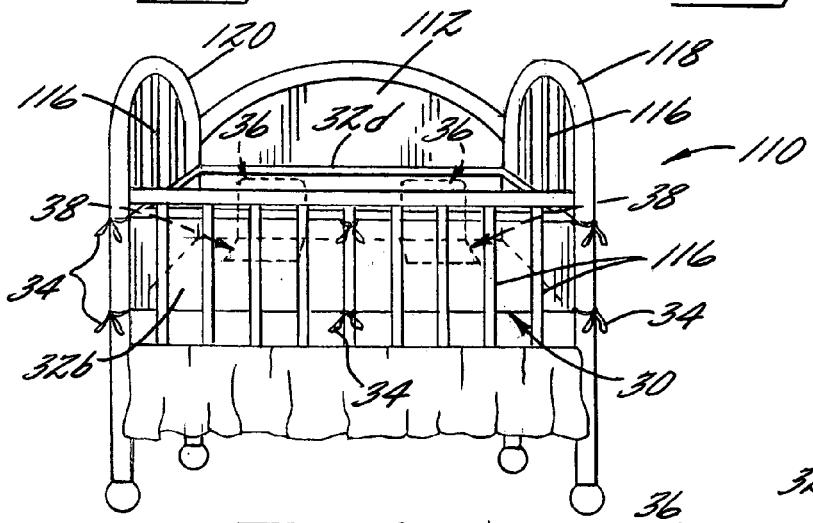
FIG. 7 is a perspective view of a crib of a second type with a bumper in accordance with the invention.

FIG. 7 shows another type of crib 110 that has one long side wall 112 that is solid, while the other long side wall 114 and the two end walls 118, 120 have spaced vertical slats 116. In this case, the ties provided on conventional crib bumpers cannot readily be attached to the solid side wall 112, particularly at the midpoint of the wall.

The crib bumper 30 shown in the drawings addresses these and other shortcomings of existing crib bumpers. The crib bumper 30 comprises an elongate rectangular strip of flexible, resiliently cushioning bumper panel material 32. The bumper panel material 32 can comprise a resiliently cushioning core of foam and/or fiber fill (not shown), and an outer covering of fabric. The particular construction of the panel material 32 is not important to the present invention. The panel material 32 can comprise one long continuous and uninterrupted strip of the panel material, or can comprise a string of four serially connected bumper panels, the bumper panels comprising a first end panel 32*a*, a first side panel 32*b*, a second end panel 32*c*, and a second side panel 32*d* for respective positioning along the crib end wall 20, side wall 12, end wall 18, and side wall 14. The crib bumper includes ties 34 attached to upper and lower edges of the panel material 32 at a number of spaced locations along the length of the panel material. For example, as shown, the ties 34 can be located so that when the panel material 32 is positioned to extend along the four sides of a standard-sized crib mattress (typically 27 to 28 inches wide by 51 to 52 inches long), the ties are located at each of the four corners and at the midpoints of the long side panels 32*b*, 32*d*.

As noted, when the crib bumper 30 is used with a crib having solid end walls as in FIG. 1, it may not be convenient or even possible to use the ties 34 at the four corners. Alternatively, when the crib bumper is used with a crib having one solid side wall as in FIG. 7, the ties 34 on the portion of the panel material that extends along the solid side wall may not be usable. Desirably, the panel material 32 should remain in a vertical orientation, should remain fully extended to its full vertical height rather than collapsing or bunching, and should remain closely adjacent the walls of the crib with the lower edge of the panel material either resting atop the upper surface of the crib mattress or tucked between the outer edge of the mattress and the adjacent crib wall. However, when some of the ties cannot be secured to the crib, the crib bumper is susceptible to becoming displaced from its proper position. Additionally, even when all of the ties can be secured to the vertical slats and/or corner posts of the crib, the ties have a tendency to slide down when the panel material is pressed downwardly, and hence the panel material can collapse or bunch up to some extent.

To address these problems, the crib bumper 30 includes a number of downwardly opening pockets 36 in the panel material 32, and a number of generally L-shaped inserts 38 that act in cooperation with at least some of the pockets 36 to secure the panel material in a vertical orientation. More particularly, there is a pocket 36 positioned approximately at a midpoint of each of the end panels 32*a*, 32*c*, and there are two spaced pockets 36 positioned along the side panel 32*d*. The pockets can be formed in various ways. In one embodiment as shown, a patch of material 37 is sewn or otherwise affixed to the panel material 32 along three sides but is left unattached along its lower edge for the insertion of an insert 38.

Figure 5:
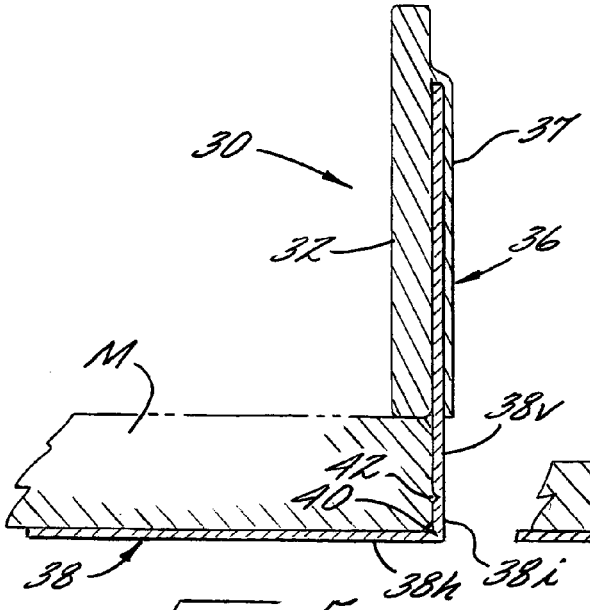
FIG. 5 is a cross-sectional view along line 5—5 in FIG. 2 through one of the pockets of the crib bumper, with the insert in a first position.
Figure 6:
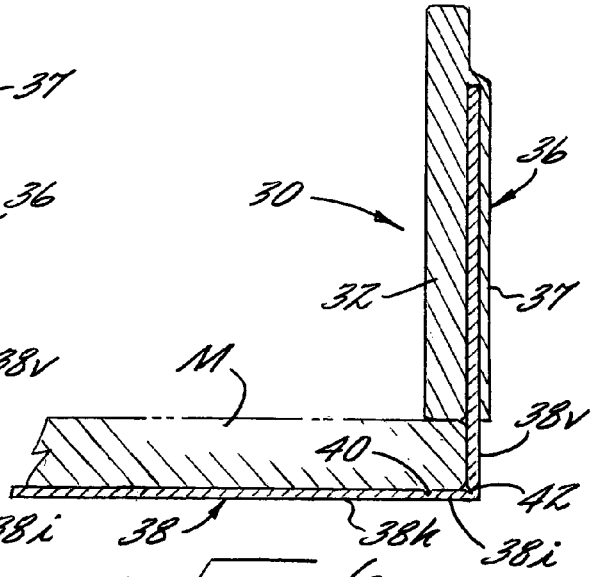
FIG. 6 is a view similar to FIG. 5, with the insert in a second position.

As shown in FIGS. 5 and 6, the L-shaped inserts 38 have a horizontal leg that is slipped between the crib mattress M and its underlying support surface (not shown, but typically consisting of a panel of spring wires or the like strung in a metal frame), and a vertical leg that extends upwardly adjacent the edge of the mattress. The vertical leg is received into a pocket 36 of the panel material 32. The length of the vertical leg exceeds the thickness of the mattress so that a portion of the vertical leg projects above the level of the mattress's upper surface. The vertical depth of the pocket 36 and the length of the vertical leg of the insert 38 are sized in relation to the mattress thickness and the vertical dimension of the panel material 32 so that when the insert leg is fully inserted into the pocket 36 as far as it will go, the lower edge of the bumper panel material 32 is at the desired location in relation to the mattress. Typically, it is desired for the lower edge of the bumper to abut the upper surface of the mattress, as shown in FIGS. 5 and 6, but alternatively the lower edge can extend somewhat below the top surface of the mattress and be tucked between the mattress and the adjacent crib wall.

Figure 2:
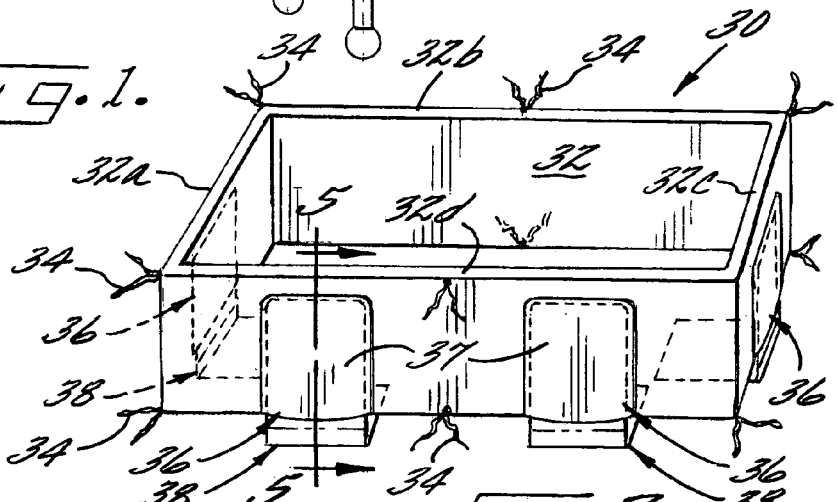
FIG. 2 is a perspective view of the crib bumper alone as positioned in the crib of FIG. 1.
Figure 3:
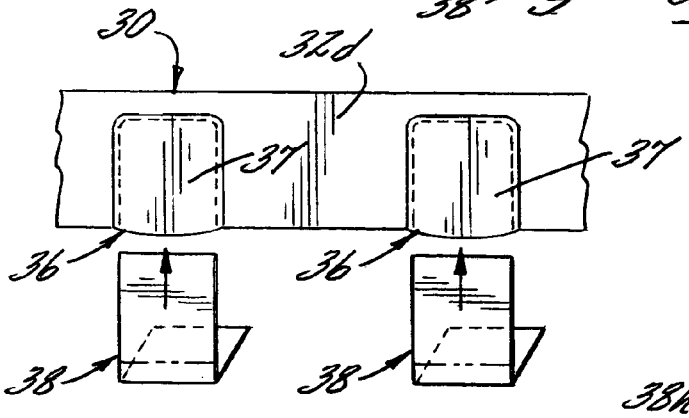
FIG. 3 is a fragmentary exploded view of one portion of the crib bumper.

When the crib bumper 30 is used with a crib of the type shown in FIG. 1, having solid end walls 18, 20, the inserts 38 are used in the pockets located on the end panels 32*a*, 32*c*, so that these end panels are supported by the inserts in a vertical orientation without the necessity of tying the bumper to the crib at the end panel locations. The inserts 38 also prevent the end panels of the bumper from slipping down and bunching up. Since both long side walls 12, 14 of the crib have spaced slats to which the ties 34 on the bumper side panel 32*d* can be tied, it is not essential to use inserts 38 in the pockets 36 on the side panel 32*d*, although optionally the inserts can be used on the panel 32*d* as shown in FIGS. 1 and 2, with or without using the ties 34. The bumper side panel 32*b* adjacent the opposite side wall 12 is secured using the ties 34 in conventional fashion.

Figure 8:
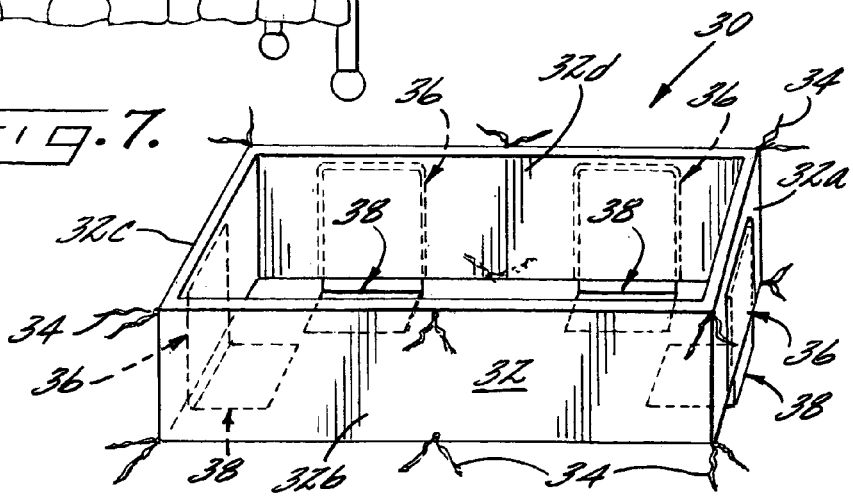
FIG. 8 is a perspective view of the crib bumper alone as positioned in the crib of FIG. 7.

When the crib bumper is used with a crib of the type shown in FIG. 7, having one long side wall 112 that is solid and the other walls being slatted, the crib bumper is oriented such that the side panel 32*d* having the pockets is against the solid wall 112, and inserts 38 are used in the pockets 36 on the side panel 32*d* to hold the side panel in its proper vertical position without the necessity of tying the side panel to the crib. Because the end walls 118, 120 of the crib have slats 116, it is not essential to use inserts 38 in the pockets 36 on the end panels 32*a*, 32*c*, although optionally the inserts can be used on the end panels as shown in FIG. 8, with or without using the ties 34 at those locations. The bumper side panel 32*b* adjacent the opposite side wall 114 is secured using the ties 34 in conventional fashion.

Figure 4:
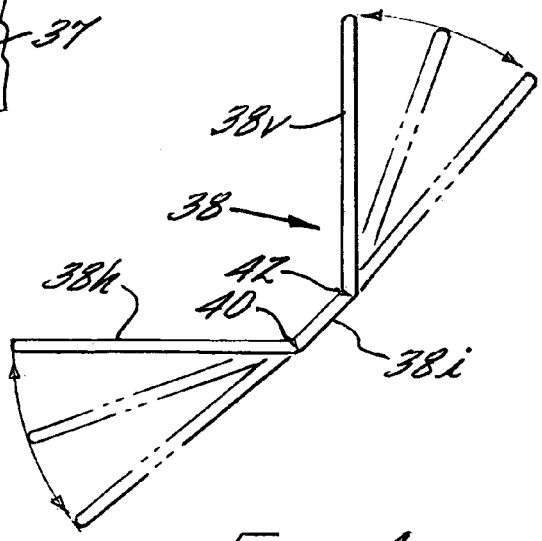
FIG. 4 is an edge-on view of one of the pocket inserts of the crib bumper, in accordance with one embodiment of the invention.

Another feature of the invention is the ability to adjust the height of the crib bumper 30 relative to the crib via a specially configured insert 38. With reference to FIGS. 4–6, This can be accomplished by providing the insert 38 such that one leg is longer than the other. The longer leg is used as the vertical leg when it is desired for the crib bumper to be relatively higher, while the shorter leg is used as the vertical leg when it is desired for the crib bumper to be relatively lower. This adjustment ability can be used, for example, to adjust the crib bumper for a relatively thicker or thinner mattress. For instance, many crib mattresses are about 4 inches thick, but some may be 5 or more inches thick. Accordingly, the insert 38 can be configured such that one leg is about 1–2 inches longer than the other. Thus, with a 4-inch mattress, the shorter leg can be positioned as the vertical leg; with a 5-inch or thicker mattress, the longer leg can be the vertical leg.

The embodiment of an insert 38 shown in FIGS. 4–6 allows this adjustment to be accomplished without having to remove the insert from beneath the mattress and flip it over. The insert 38 comprises a horizontal leg 38*h*, a vertical leg 38*v*, and an intermediate portion 38*i* between the two legs. One edge of the intermediate portion is connected to the horizontal leg by a first hinge 40, and the other edge is connected to the vertical leg by a second hinge 42. The hinges 40, 42 are configured to allow the legs 38*h*, 38*v* to be rotated relative to the intermediate portion 38*i* by at least 90 degrees, from an included angle of about 180 degrees as shown in phantom lines in FIG. 4 to an angle of about 90 degrees. Consequently, the insert 38 is convertible between two positions, respectively shown in FIGS. 5 and 6. In the first position of FIG. 5, the vertical leg 38*v* and the intermediate portion 38*i* are coplanar (i.e., the second hinge 42 is in its 180-degree position) and the horizontal leg 38*h* is perpendicular to the vertical leg and intermediate portion (i.e., the first hinge 40 is in its 90-degree position). In this first position, the height of the vertical leg is extended by the height of the intermediate portion 38*i*, which suitably can be about 1–2 inches. In the second position shown in FIG. 6, the horizontal leg 38*h* and the intermediate portion 38*i* are coplanar (i.e., the first hinge 40 is in its 180-degree position) and the vertical leg 38*v* is perpendicular to the horizontal leg and intermediate portion (i.e., the second hinge 42 is in its 90-degree position). In this position, the height of the vertical leg is not extended. This conversion of the insert 38 from one position to the other can accommodate different mattress thicknesses as illustrated in FIGS. 5 and 6, such that the lower edge of the crib bumper is positioned at or slightly below the upper surface of the mattress. Additionally, this conversion can be accomplished while the insert is still in its installed position beneath the mattress and in a pocket, which affords the ability to adjust the height of the crib bumper to the individual user's liking from one moment to another, without having to remove the bumper from the crib; any ties 34 that are tied to crib slats or corner posts can simply be slid upwardly or downwardly along those members.

The inserts 38 can be made of various materials and by various processes. As one example, the inserts can be molded from plastic material; the hinges 40, 42, if present, can comprise living hinges. Alternatively, the inserts can be formed of plastic- or vinyl-covered cardboard or the like; the portions 38*h*, 38*v*, 38*i* can comprise separate pieces of cardboard held together by the plastic or vinyl covering, with the hinges 40, 42 formed by the covering material. This construction is similar to that of a 3-ring binder.

The inserts 38 and associated pockets 36 in the crib bumper can have various dimensions. Suitably, the horizontal width of the insert can be about 15 to 30 cm (6 to 12 inches), and more preferably about 28 to 30 cm (11 to 12 inches). Each of the legs 38*v*, 38*h* can have a length of about 22 to 25 cm (8.5 to 12 inches), and more preferably about 24 cm (9.5 inches). The intermediate portion 38*i* has a length of about 2.5 to 5 cm (1 to 2 inches). The pockets, correspondingly, can have a horizontal width slightly greater than the width of the inserts to allow the inserts to fit into the pockets with minimal side-to-side play. The vertical height of the pockets can vary depending not only on the height dimensions of the inserts but also on the intended position of the crib bumper panel material 32 relative to the upper surface of the mattress. For instance, the crib bumper can be designed to be tucked between the edges of the mattress and the adjacent crib walls, with the lower edge of the panel material being at about the same height as the lower surface of the mattress. In this case, the panel material 32 has a vertical height exceeding the mattress thickness by a suitable amount, such as about 6 to 9 inches (e.g., for a 4- or 5-inch thick mattress, the panel material can have a height of about 10 to 14 inches), and the pockets 36 can have a height approximately the same as the length of the legs of the insert. Alternatively, the crib bumper can be designed so that the lower edge of the bumper abuts the upper surface of the mattress as in FIGS. 5 and 6. In this case, the legs of the inserts 38 must be longer than the pocket height by an amount equal to the mattress thickness, and the panel material 32 can have a vertical height of a suitable amount, such as about 6 to 9 inches. The foregoing discussion assumes, of course, that the pockets extend all the way down to the lower edge of the panel material 32 as shown in the drawings. This is not a necessity, but it is preferred so that the extent of the inserts 38 that is exposed is minimized.

Many modifications and other embodiments of the inventions set forth herein will come to mind to one skilled in the art to which these inventions pertain having the benefit of the teachings presented in the foregoing descriptions and the associated drawings. For example, while the illustrated and described crib bumper 30 has a plurality of pockets 36, it is within the scope of the invention to include a single pocket, such as one relatively long pocket along one long side panel of the crib bumper; a crib bumper of this configuration may be specifically designed for use with a crib having one solid side wall as in FIG. 7. Also included within the scope of the invention is a crib bumper specifically designed for use with a crib of the type shown in FIG. 1, having solid end walls, wherein each of the end panels 32*a, c* of the bumper has a pocket 36 but there are no pockets in the side panels 32*b, d*. Other variations are also possible. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A crib bumper, comprising:

flexible, resiliently cushioning bumper panel material defining a plurality of downwardly opening pockets spaced apart along a length of the bumper panel material; and a generally L-shaped insert for each of at least some of the pockets, each insert defining a horizontal leg structured and arranged to be slipped beneath a crib mattress and a vertical leg structured and arranged to be received into a respective one of the pockets in the bumper panel material, such that the inserts position the bumper panel material in a vertical orientation adjacent the crib mattress.

2. The crib bumper of claim 1, wherein the bumper panel material comprises a string of four interconnected bumper panels, each bumper panel structured and arranged to extend along a respective one of four sides of a crib mattress.

3. The crib bumper of claim 2, wherein at least one of the bumper panels defines two said pockets spaced apart along the panel.

4. The crib bumper of claim 1, wherein each of the inserts includes a hinged connection between the vertical leg and the horizontal leg, the hinged connection allowing the vertical leg to be pivoted relative to the horizontal leg.

5. The crib bumper of claim 4, wherein the hinged connection of each insert is structured and arranged to allow the vertical leg to be pivoted into a position substantially coplanar with the horizontal leg.

6. The crib bumper of claim 1, wherein each of the inserts is convertible from a first position to a second position, the first and second positions having different heights of the vertical leg relative to the horizontal leg.

7. The crib bumper of claim 6, wherein each of the inserts includes an intermediate portion between the vertical leg and the horizontal leg, a first hinge connecting the vertical leg to one edge of the intermediate portion, and a second hinge connecting an opposite edge of the intermediate portion to the horizontal leg, each of the hinges being structured and arranged to allow the intermediate portion to be pivoted between coplanar and perpendicular positions relative to the respective legs, wherein the first position of each insert has the intermediate portion coplanar with the horizontal leg and perpendicular to the vertical leg, and the second position of each insert has the intermediate portion coplanar with the vertical leg and perpendicular to the horizontal leg.

8. The crib bumper of claim 7, wherein the inserts are molded plastic and the hinges comprise living hinges.

9. The crib bumper of claim 1, further comprising ties affixed to the bumper panel material for securing the crib bumper to structural members of a crib.

10. The crib bumper of claim 1, wherein the pockets are defined at an outward-facing surface of the bumper panel material that faces away from the interior of a crib.

11. The crib bumper of claim 10, wherein each pocket is defined between the outward-facing surface of the bumper panel material and a patch of material sewn to the outward-facing surface.

12. The crib bumper of claim 1, wherein the bumper panel material comprises a string of four serially connected bumper panels, the bumper panels comprising a first end panel, a first side panel, a second end panel, and a second side panel for respective positioning along a first end, a first side, a second end, and a second side of a crib, and wherein each of the first and second end panels defines at least one said pocket.

13. The crib bumper of claim 12, wherein the first side panel defines at least two said pockets.

14. The crib bumper of claim 13, wherein the second side panel is free of pockets.

15. A crib bumper, comprising:

a string of interconnected flexible, resiliently cushioning bumper panels, the bumper panels comprising a first end panel, a first side panel, a second end panel, and a second side panel for respective positioning along a first end, a first side, a second end, and a second side of a crib, at least one of the bumper panels defining at least one downwardly opening pocket; and a generally L-shaped insert for each said pocket, each insert defining a horizontal leg structured and arranged to be slipped beneath a crib mattress and a vertical leg structured and arranged to be received into the respective pocket in the bumper panel for holding the bumper panel in a vertical orientation adjacent the crib mattress.

16. A crib bumper, comprising:

a string of interconnected flexible, resiliently cushioning bumper panels, the bumper panels comprising a first end panel, a first side panel, a second end panel, and a second side panel for respective positioning along a first end, a first side, a second end, and a second side of a crib, each of the end panels defining at least one downwardly opening pocket and at least one of the side panels defining at least two downwardly opening pockets; and a generally L-shaped insert for each of at least some of the pockets, each insert defining a horizontal leg structured and arranged to be slipped beneath a crib mattress and a vertical leg structured and arranged to be received into a respective one of the pockets in the bumper panels for holding the bumper panels in a vertical orientation adjacent the crib mattress.

17. A crib bumper, comprising:

a string of interconnected flexible, resiliently cushioning bumper panels, the bumper panels comprising a first end panel, a first side panel, a second end panel, and a second side panel for respective positioning along a first end, a first side, a second end, and a second side of a crib, each of the end panels defining at least one downwardly opening pocket and at least one of the side panels defining at least one downwardly opening pocket; and a generally L-shaped insert for each of at least some of the pockets, each insert defining a horizontal leg structured and arranged to be slipped beneath a crib mattress and a vertical leg structured and arranged to be received into a respective one of the pockets in the bumper panels for holding the bumper panels in a vertical orientation adjacent the crib mattress, and each insert being structured and arranged to be convertible from a first position to a second position, the first and second positions having different heights of the vertical leg relative to the horizontal leg.

18. The crib bumper of claim 17, wherein each insert includes an intermediate portion between the vertical leg and the horizontal leg, a first hinge connecting the vertical leg to one edge of the intermediate portion, and a second hinge connecting an opposite edge of the intermediate portion to the horizontal leg, each of the hinges being structured and arranged to allow the intermediate portion to be pivoted between coplanar and perpendicular positions relative to the respective legs, wherein the first position of each insert has the intermediate portion coplanar with the horizontal leg and perpendicular to the vertical leg, and the second position of each insert has the intermediate portion coplanar with the vertical leg and perpendicular to the horizontal leg.

19. The crib bumper of claim 18, wherein each insert is molded plastic and the hinges comprise living hinges.

20. A crib bumper, comprising:

a string of interconnected flexible, resiliently cushioning bumper panels, the bumper panels comprising a first end panel, a first side panel, a second end panel, and a second side panel for respective positioning along a first end, a first side, a second end, and a second side of a crib, each of the end panels defining at least one downwardly opening pocket and the first side panel defining at least one downwardly opening pocket for receiving upwardly projecting support members associated with the crib, the second side panel being free of any pocket for receiving a support member.

* * * * *